US008905904B2

(12) United States Patent
Carter

(10) Patent No.: US 8,905,904 B2
(45) Date of Patent: Dec. 9, 2014

(54) ADJUSTABLE RESISTANCE EXERCISE APPARATUS

(76) Inventor: Marcus Carter, Tampa, FL (US)

( * ) Notice: Subject to any disclaimer, the term of this patent is extended or adjusted under 35 U.S.C. 154(b) by 259 days.

(21) Appl. No.: 13/524,830

(22) Filed: Jun. 15, 2012

(65) Prior Publication Data

US 2012/0322635 A1 Dec. 20, 2012

Related U.S. Application Data

(60) Provisional application No. 61/497,268, filed on Jun. 15, 2011, provisional application No. 61/500,145, filed on Jun. 23, 2011.

(51) Int. Cl.
*A63B 21/04* (2006.01)
*A63B 21/00* (2006.01)
*A63B 23/12* (2006.01)

(52) U.S. Cl.
CPC ..... *A63B 21/0442* (2013.01); *A63B 21/151* (2013.01); *A63B 21/1469* (2013.01); *A63B 23/1245* (2013.01); *A63B 21/1419* (2013.01); *A63B 21/00069* (2013.01); *A63B 21/1415* (2013.01); *A63B 21/1449* (2013.01)
USPC ..... 482/129; 482/121

(58) Field of Classification Search
CPC ..... A63B 21/0552; A63B 21/02; A63B 21/0442; A63B 21/0557; A63B 21/1469; A63B 21/1419; A63B 21/1449; A63B 21/1415; A63B 23/0355
USPC ..... 482/121–127, 129; 242/159, 169, 370, 242/227–236; 119/794, 858
See application file for complete search history.

(56) References Cited

U.S. PATENT DOCUMENTS

| | | | | | |
|---|---|---|---|---|---|
| 4,114,875 | A * | 9/1978 | Deluty | 482/120 |
| 4,685,671 | A * | 8/1987 | Hagerman et al. | 482/124 |
| 5,358,461 | A * | 10/1994 | Bailey, Jr. | 482/2 |
| 5,518,480 | A * | 5/1996 | Frappier | 482/124 |
| 5,618,249 | A * | 4/1997 | Marshall | 482/127 |
| 5,876,310 | A * | 3/1999 | Mackey et al. | 482/74 |
| 6,123,649 | A * | 9/2000 | Lee et al. | 482/54 |
| 6,149,559 | A * | 11/2000 | Mackey | 482/124 |
| 6,210,348 | B1 * | 4/2001 | Reed | 601/23 |
| 6,309,328 | B1 * | 10/2001 | Dudley | 482/120 |
| 6,315,701 | B1 * | 11/2001 | Shifferaw | 482/114 |
| 6,712,026 | B1 * | 3/2004 | Carville, Jr. | 119/796 |
| 6,770,014 | B2 * | 8/2004 | Amore | 482/92 |
| 7,621,856 | B1 * | 11/2009 | Keith et al. | 482/127 |
| 7,854,694 | B1 * | 12/2010 | Frunzi | 482/124 |
| 8,105,214 | B2 * | 1/2012 | Jahns | 482/110 |

(Continued)

*Primary Examiner* — Stephen Crow
*Assistant Examiner* — Andrew S Lo
(74) *Attorney, Agent, or Firm* — Robert M. Downey, P.A.

(57) ABSTRACT

An apparatus includes adjustable resistance exercise assisting devices, including a hand grip and a bar grip, each having a length of cable wound about and fixed at one end to a cable spool and an opposite end with a quick connect fitting for removable attachment to an anchor point, whereupon forced movement of the exercise assisting device away from the anchor point, by pulling, pressing or pushing in the performance of various exercise movements, causes the cable spool to rotate against resistance imparted by a resistance adjustment mechanism. In one embodiment, the resistance adjusting mechanism includes a piston that moves against pressure within a variable volume airtight chamber as the cable spool rotates. The apparatus may also include a rigid garment that is worn about the human torso and which includes multiple anchor points for attachment of the cable quick connect fitting thereto.

17 Claims, 7 Drawing Sheets

(56) References Cited

U.S. PATENT DOCUMENTS

| | | | | |
|---|---|---|---|---|
| 8,695,537 | B2 * | 4/2014 | Bizzell et al. | 119/796 |
| 2002/0086779 | A1 * | 7/2002 | Wilkinson | 482/118 |
| 2003/0013585 | A1 * | 1/2003 | Chen | 482/115 |
| 2003/0087735 | A1 * | 5/2003 | Chen | 482/116 |
| 2003/0114278 | A1 * | 6/2003 | Rigas | 482/116 |
| 2004/0053755 | A1 * | 3/2004 | Wilkinson | 482/124 |
| 2004/0142799 | A1 * | 7/2004 | Yeo et al. | 482/126 |
| 2005/0159276 | A1 * | 7/2005 | Falcone | 482/123 |
| 2008/0224110 | A1 * | 9/2008 | Starks et al. | 254/264 |
| 2008/0254945 | A1 * | 10/2008 | Beyzavi-Armani | 482/8 |
| 2009/0011909 | A1 * | 1/2009 | Glisan | 482/129 |
| 2009/0227433 | A1 * | 9/2009 | Humble et al. | 482/129 |
| 2009/0280969 | A1 * | 11/2009 | Smith | 482/124 |
| 2010/0279830 | A1 * | 11/2010 | Snagg | 482/124 |
| 2010/0314479 | A1 * | 12/2010 | Kish et al. | 242/376 |
| 2011/0111890 | A1 * | 5/2011 | Webb et al. | 473/458 |
| 2011/0315090 | A1 * | 12/2011 | Marshall | 119/796 |
| 2012/0058864 | A1 * | 3/2012 | Mizrachy | 482/124 |
| 2013/0000566 | A1 * | 1/2013 | Berton | 119/796 |
| 2013/0048929 | A1 * | 2/2013 | Starks et al. | 254/362 |
| 2013/0145994 | A1 * | 6/2013 | Lash | 119/796 |
| 2013/0167781 | A1 * | 7/2013 | Marshall | 119/794 |
| 2014/0084229 | A1 * | 3/2014 | Morrison | 254/344 |

* cited by examiner

ADJUSTABLE RESISTANCE EXERCISE APPARATUS

BACKGROUND OF THE INVENTION

This non-provisional patent application is based on U.S. provisional patent application Ser. No. 61/497,268 filed on Jun. 15, 2011 and U.S. provisional patent application Ser. No. 61/500,145 filed on Jun. 23, 2011.

FIELD OF THE INVENTION

This invention relates generally to exercise devices and equipment and, more particularly, to a portable and adjustable resistance exercise apparatus including hand-held devices with extendable and retractable cables or cords that attach to anchor points.

Exercise is a necessary activity in maintaining the health of the human body. As modern countries have grown from agrarian cultures to industrialized nations with occupations moving from the fields to offices, human health has suffered from the loss of daily musculature activity. The workout craze beginning in the 1970's and subsequent growth of the gym industry has capitalized on the need for specialized equipment for exercising the sedentary human body. The home gym industry has seen explosive growth due to the hectic daily schedules of many individuals who do not have time to go to a commercial gym, as well as individuals who prefer to exercise in the privacy of their homes. Moreover, maintaining a gym membership over the course of several years can be very expensive and is beyond the budget of many individuals and families.

Home based exercise equipment relies primarily upon the physics of lifting weight as a means of creating resistance to exercise the human body. This necessitates that the equipment be heavy and bulky which limits it to stationary use in one area of the home. In addition, the equipment is complex and the process of adjusting weight can be time consuming.

Other exercise devices are designed to attach to and be used with doorframes (for example) in a similar manner. However; these other devices (e.g., elastic bands) are limited to a fixed resistance.

OBJECTS AND ADVANTAGES OF THE INVENTION

It is the general object of the invention to provide an easy to use, lightweight, and portable apparatus and method of exercising multiple muscle groups at home or away from the home.

It is a further object of the invention to provide a portable exercise apparatus that allows for an easy and quick changeover from one exercise to another, as well as quick and easy adjustment of resistance between sets of any given exercise.

It is a further object of the present invention to provide a portable adjustable resistance exercise apparatus that can be used to exercise broad muscle groups or used for isolation exercises.

It is still a further object of the present invention to provide a portable and adjustable resistance exercise apparatus that can be used with stationary anchor points like walls or doorframes, and when used in this manner, can provide adjustable resistance not available by other exercise apparatus in the related art.

It is still a further object of the present invention to provide a portable and adjustable resistance exercise apparatus that can rely upon the mass of the human body as the base anchor point of resistance, thereby providing the user with a lightweight, easy to use and portable exercise apparatus.

It is yet a further object of the present invention to provide a portable and adjustable resistance exercise apparatus that enables the user to move about the home or other area while exercising, and which further allows the user to exercise while performing other tasks such as speaking on the telephone.

These and other objects and advantages of the invention are readily apparent with reference to the detailed description and accompanying drawings.

SUMMARY OF THE INVENTION

An exercise apparatus is provided for exercising various muscle groups of the human body without the need for heavy, bulky, non-portable equipment. The apparatus includes adjustable resistance exercise assisting devices, including a hand grip and a bar grip, each having a length of cable wound about and fixed at one end to a cable spool and an opposite end with a quick connect fitting for removable attachment to an anchor point, whereupon forced movement of the exercise assisting device away from the anchor point, by pulling, pressing or pushing in the performance of various exercise movements, causes the cable spool to rotate against resistance imparted by a resistance adjustment mechanism. In one embodiment, the resistance adjusting mechanism includes a piston that moves against pressure within a variable volume airtight chamber as the cable spool rotates. The apparatus may also include a rigid garment that is worn about the human torso and which includes multiple anchor points for attachment of the cable quick connect fitting thereto.

BRIEF DESCRIPTION OF THE DRAWINGS

For a fuller understanding of the nature of the present invention, reference should be made to following detailed description taken in conjunction with the accompanying drawings in which.

Like reference numerals refer to like parts throughout the several views of the drawings.

DETAILED DESCRIPTION OF THE PREFERRED EMBODIMENT

Figure 1:
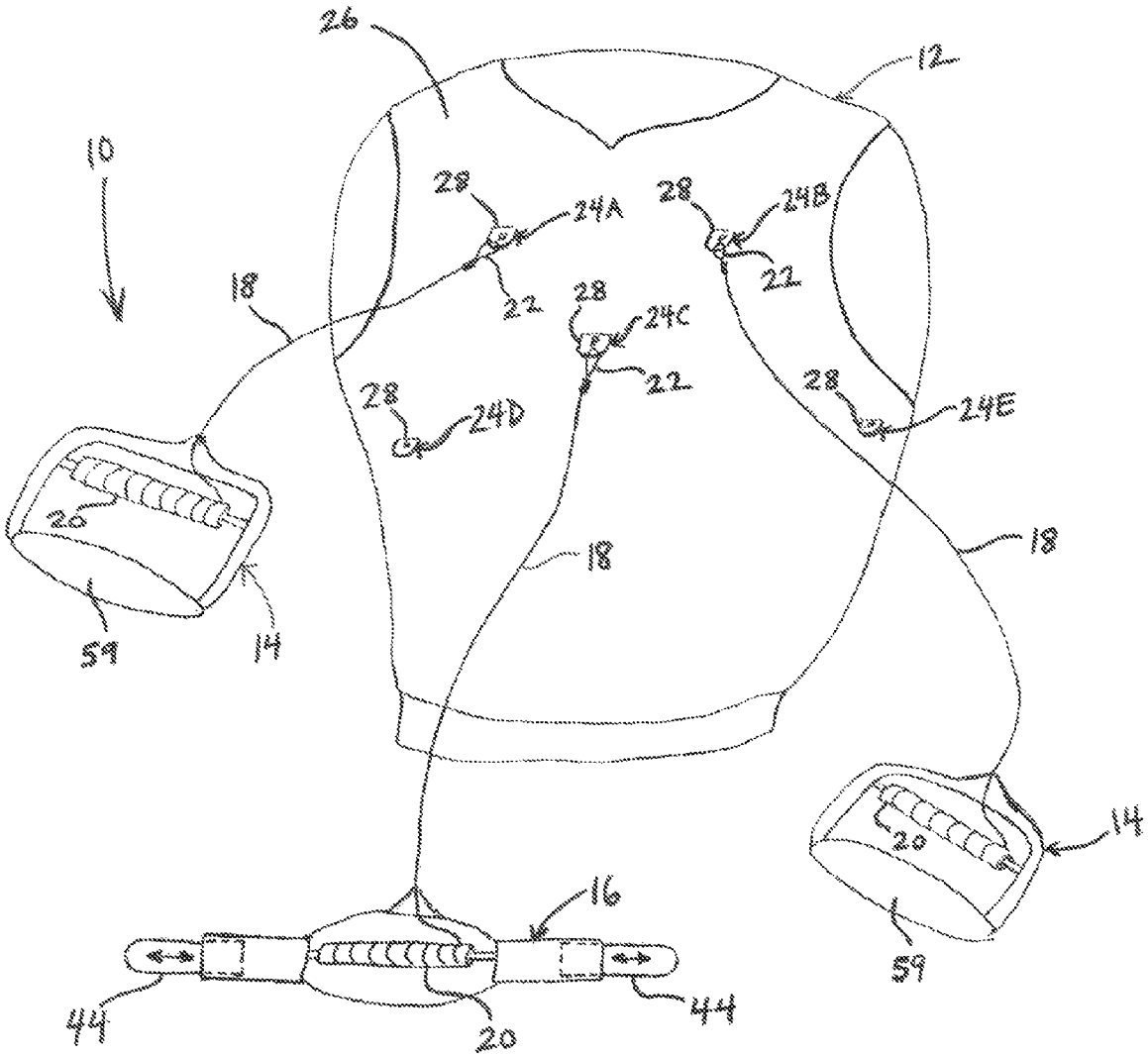
FIG. 1 is a perspective view of one embodiment of the invention showing several adjustable resistance handheld exercise assisting devices each having a cable attached to anchor points on a rigid chest plate of a body garment.

Referring initially to FIG. 1, the exercise apparatus of the present invention is shown in accordance with one embodiment thereof and includes a plurality of adjustable resistance handheld exercise assisting devices 10 and a body garment 12 that is structured to be worn about the human torso. The plurality of adjustable resistance handheld exercise assisting devices 10 include one or more hand grip devices 14 and a bar grip device 16. Each of these handheld devices 14 or 16 includes a length of cable 18 that is wound about and fixed at one end to a cable spool 20 on the device 14 or 16. An opposite end of the cable 18 is provided with a quick connect fitting 22 for easy and rapid connection and disconnection to various anchor points 24A, 24B, 24C provided on the body garment. As seen in FIG. 1, the body garment 12 includes a rigid breast plate 26 having an arrangement of rings 28, or other quick connect hardware fittings, that define the anchor points 24A-24E. These rings 28 or other fittings are arranged at specific locations for performing various exercise movements. More specifically, strategic anchor points 24A-24E on the breast plate 26 provide focal points of resistance for certain exercises. Resistance anchor points 24A and 24B provide the best attachment point for the quick connect fitting 22 of the hand grip device 14 or the un-extended bar grip 16 when performing a narrow grip bench press exercise. Resistance anchor point 24C provides the best attachment point for the quick connect fitting 22 of the bar grip 16 for performing various narrow or medium grip exercises. While resistance anchor points 24D and 24E provide the best attachment points for the handheld devices while performing a medium grip bench press exercise.

Figure 2:
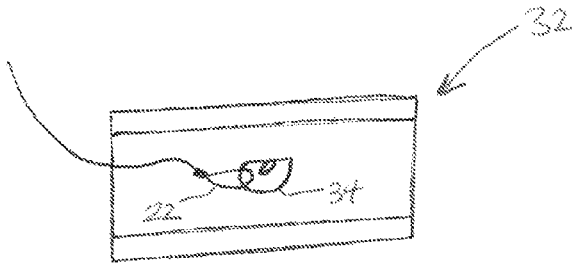
FIG. 2 is an isolated front elevational view of a belt, in accordance with one embodiment of a body garment of the present invention, showing the end of a cable from an adjustable resistance handheld exercise assisting device attached to an anchor point on the belt.

FIG. 2 shows an alternative body garment 32 in the form of a leather belt with a metal band. The metal band has an embedded loop or ring defining the anchor point 34. The cable assembly from either the hand grip device 14 or the bar grip device 16 can be attached to anchor point 34 on the belt in order to perform a full range of motion for certain exercises, such as a bicep curl.

Figure 3:
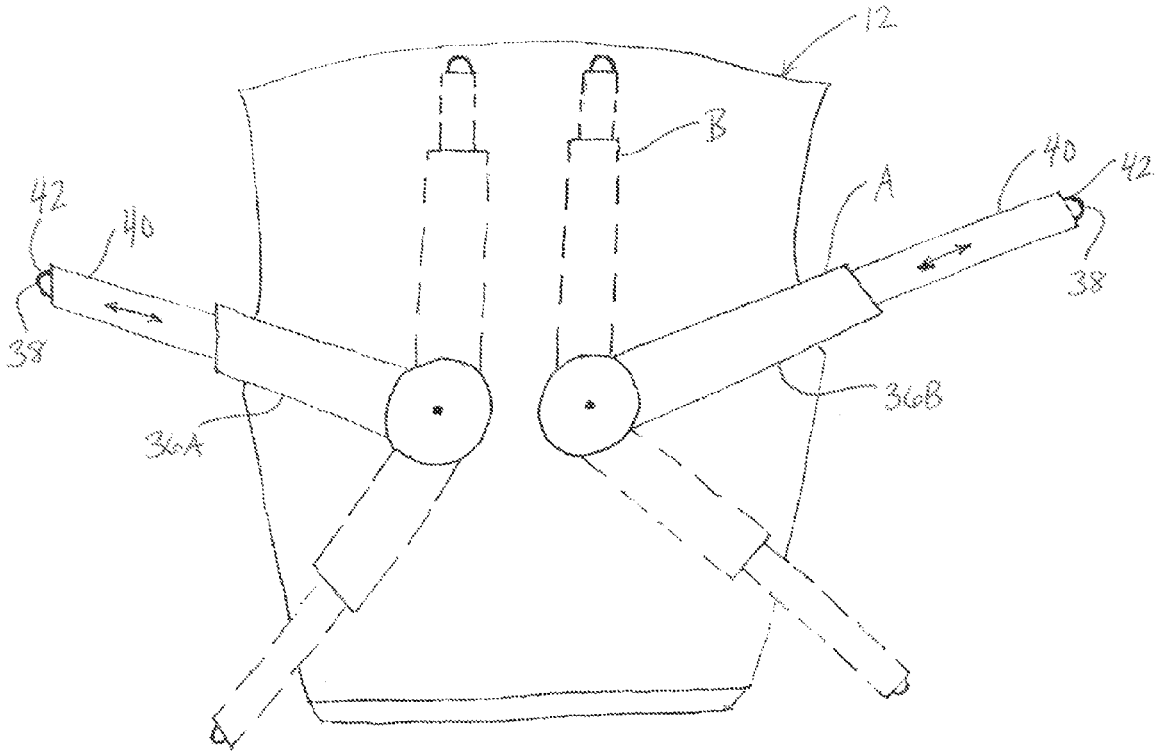
FIG. 3 is a rear elevational view of the body garment of FIG. 1 illustrating a pair of anchor arms with associated extender arms pivotally fitted to a rigid back panel of the body garment, wherein adjusted positions of the anchor arms and extender arms are illustrated in broken lines.

FIG. 3 illustrates two anchor arms 36A and 36B affixed to the back side of the body garment 12 of FIG. 1. Each arm 36A and 36B has an anchor point loop or D ring (as described in more detail hereinafter) 38 attached at the extremity of an arm extender 40 and defining an anchor point 42. The extender arm 40 for each anchor arm 36A and 36B is moveable between a retracted position and one or more extended positions. The extender arms 40 slide in a telescoping action from within the respective anchor arms 36A and 36B and lock at the retracted position and the one or more extended positions. The anchor arms 36A and 36B pivot and lock into place at select positions for performing various exercises as shown in broken lines. In one position, the anchor arms 36A and 36B can be used for very wide grip exercises like the cable cross over or can be repositioned for narrow grip exercises like the triceps extension. In order to accomplish the cable cross over exercise, the quick connect fitting 22 of the hand grip 14 is attached to anchor point ring of either anchor arm with the arms positioned as indicated as A in FIG. 3. To accomplish the triceps extension exercise, the quick connect fitting of the bar grip is attached to either anchor point 42 on the extender arms 40 while the anchor arms 36A and 36B are in position indicated as B in FIG. 3. Each extender arm 40 can be pushed back into the anchor arm 36A and 36B in a telescoping retraction action, as shown in FIG. 3, when not in use.

As shown in FIG. 1, the bar grip device 16 can be extended. When deployed in this manner and attached to an anchor point 24A-24E, the bar grip 16 with bar grip extenders 44 that can be used for wide grip exercises such as the wide grip bench press. When attached to an anchor point 24A-24E, and not extended, the bar grip device 16 can be used for various narrow or medium grip exercises. Quick connect fitting 22, cable 18, and the cable spool 20 of the bar grip device 16 are used in the same manner as with the hand grip device 14. The purpose for using the bar grip device 16 instead of the hand grip device 14 is to provide more uniform resistance for each arm during certain exercises.

Figure 4:
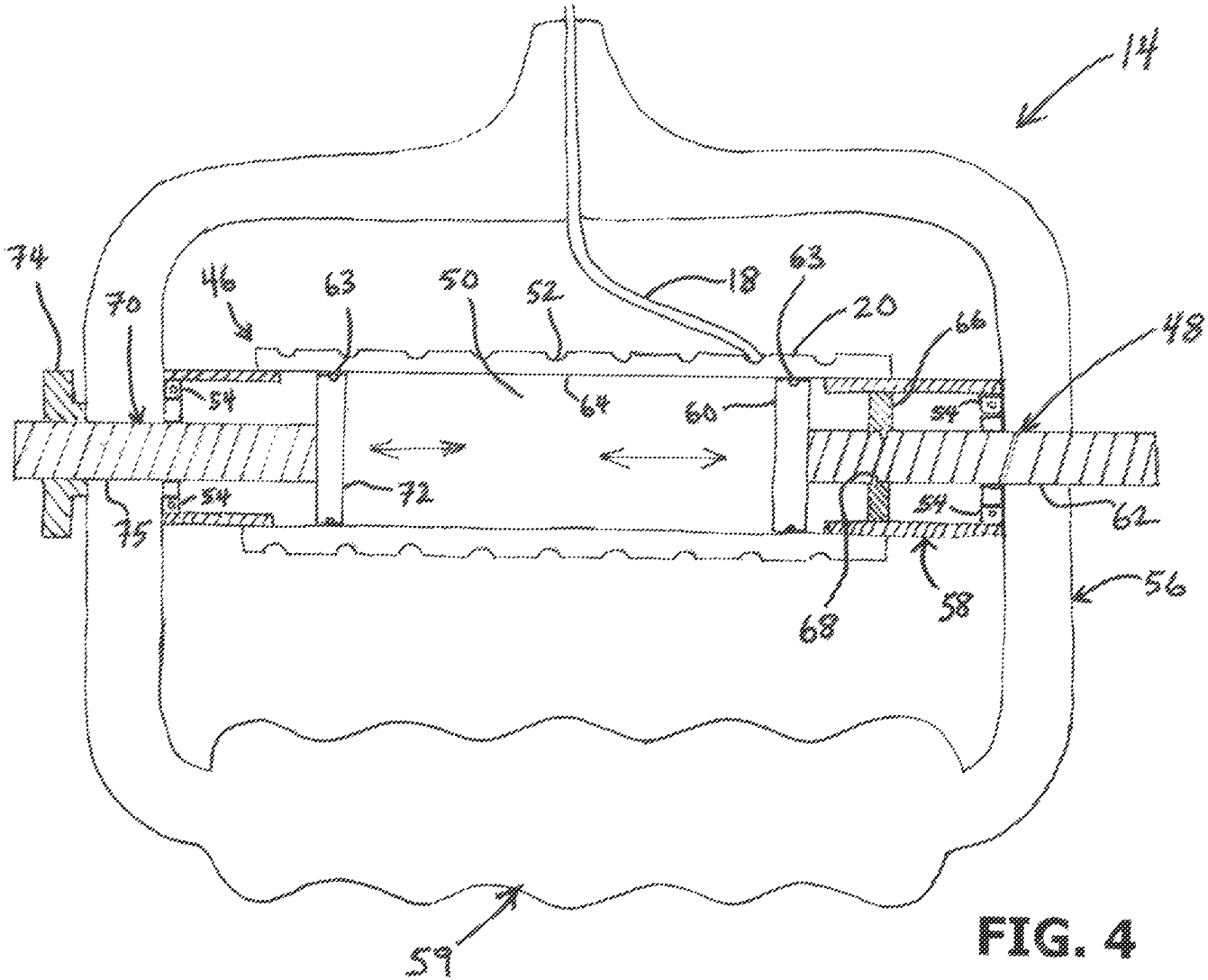
FIG. 4 is an isolated view of a hand grip device of the present invention with a resistance adjusting mechanism illustrated in cross-section.
Figures 5, 6:
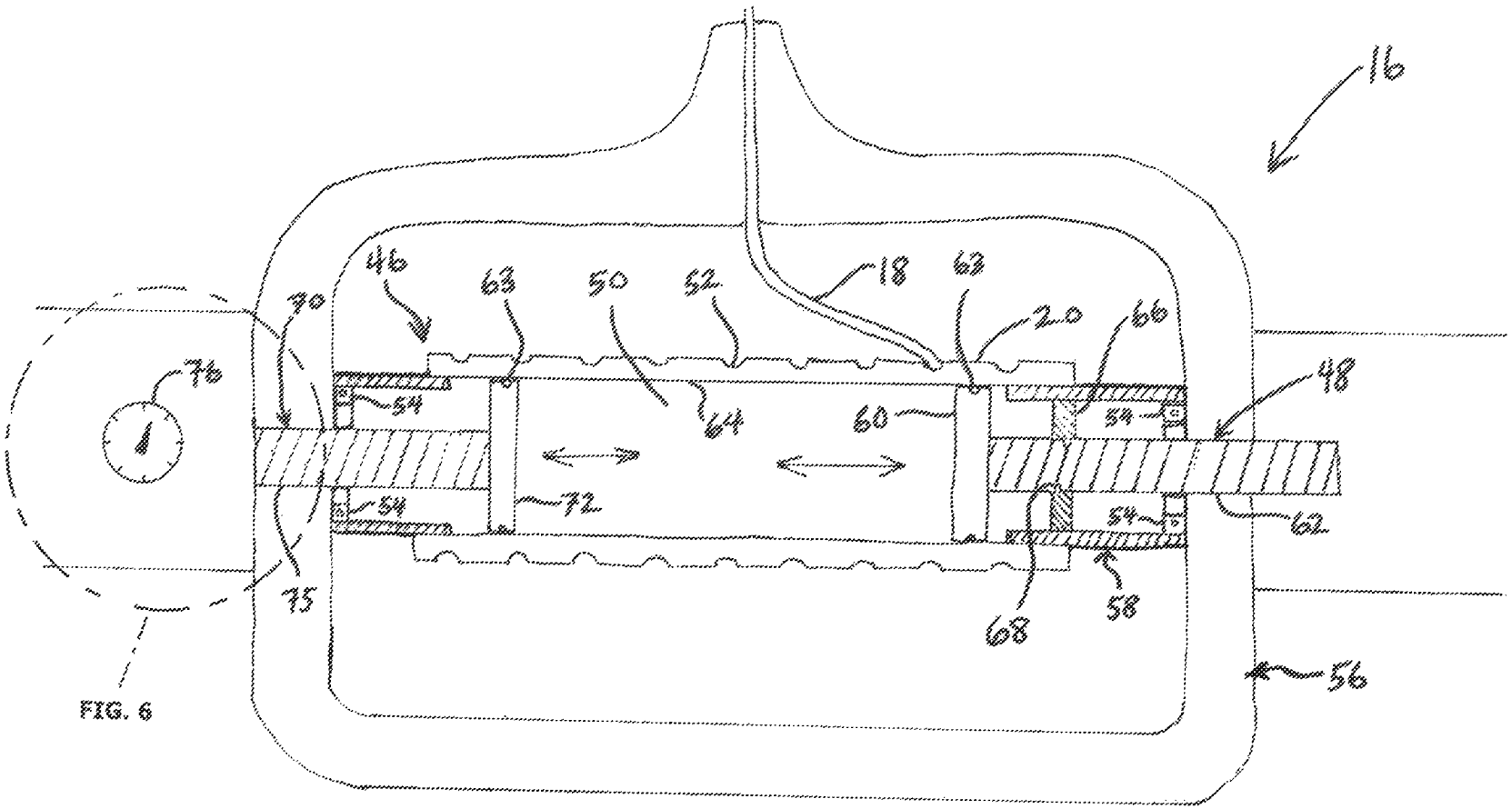
FIG. 5 is an isolated view of a bar grip device according to the present invention, wherein a resistance adjusting mechanism is illustrated in cross-section.
FIG. 6 is an isolated view, shown in partial cross-section, showing a bevel gear arrangement for adjusting a pre-stroke pressure within an airtight chamber of the resistance adjusting mechanism.
Figure 6:
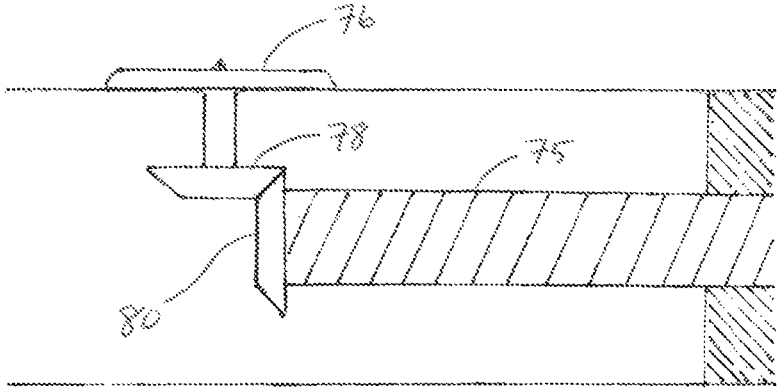

Referring to FIGS. 4 and 5, the adjustable resistance handheld exercise devices 10 each include a resistance adjusting mechanism 46 for imparting a force of resistance against rotation of the cable spool 20 when the user moves the handheld device 10, such as the hand grip device 14 or bar grip device 16, away from the anchor point 24A-24E. More specifically, the user grasps the handheld exercise device 10 and, as force is applied through the exercise motion away from the attached anchor point 24A-24E, the cable 18 is pulled from the cable spool 20, thereby rotating the spool 20 against the adjusted force of resistance imparted by the resistance adjusting mechanism. In one embodiment (not shown) the resistance adjusting mechanism 46 includes at least one spring that resists rotation of the cable spool. Tension of the at least one spring can be adjusted to thereby adjust the resistance of rotation of the cable spool 20. In another embodiment of the resistance adjusting mechanism 46, as shown in FIGS. 4 and 5, a piston 48 moves against pressure within a variable volume airtight chamber 50 as the cable spool 20 rotates. More specifically, cable spool 20 is rotatably supported on a cable spool axle 52 that rotates on roller bearings 54 fitted to the frame 56 and/or a frame axle member 58. A hand grip 59 is integrally attached to frame 56 and is sized for grasping by a user's hand. The piston 48 includes a piston head 60 and a piston rod 62 that extends through the frame axle member 58 and frame 56. The piston head 60 is positioned within the airtight chamber 50 that is surrounded by the axle spool 52. A seal 63 is provided about the piston head 60 for sealed engagement with an inner cylindrical surface 64 of the cable spool 20 surrounding the airtight chamber 50. An inward facing gear 66 is permanently affixed to the inside wall of the cable spool axle 52 and turns with the cable spool axle 52 and cable spool 20 relative to the piston 48, frame 56 and frame axle member 58. The piston rod 62 has a spiral screw groove substantially along its length and is held in place through the frame axle member 58 and within the inward facing gear 66. A spiral ring 68 within the inward facing gear 66 engages the spiral screw groove of the piston rod 62 and is pitched to travel within the spiral screw groove substantially along the length of the piston rod 62 upon rotation of the inward facing gear 66 relative to the piston rod 62. Rotation of the cable spool 20 and cable spool axle 52 results in rotation of the inward gear 66 around the piston rod 62, thereby causing the spiral ring 68 of the inward facing gear 66 to ride within the spiral groove of the piston rod 62, which results in axial movement of the piston 48, including the piston head 60, within the airtight chamber 50, as indicated by the arrow in FIG. 4. As the cable 18 is pulled from the cable spool 20, cable spool axle 52 and inward gear 66 are rotated in one direction which causes the piston 48 and piston head 60 to move inwardly into the airtight chamber 50 against the air pressure of the sealed chamber. Naturally, this results in a force of resistance against the force of rotation of the cable spool 20.

In order to adjust the force of resistance of rotation of the cable spool 20, the interior volume of the airtight chamber 50 can be varied, thereby changing the pre-stroke pressure in the airtight chamber 50. In the embodiment shown in FIGS. 4 and 5, adjusting of the pre-stroke pressure within the airtight chamber 50, and accordingly, the starting resistance of rotation of the cable spool 20, is achieved by movement of a second piston that serves as a resistance adjusting piston 70. More specifically, movement of the piston head 72 of the resistance adjusting piston 70 inwardly and outwardly relative to the airtight chamber 50, as indicated by the arrow in FIGS. 4 and 5, changes the volume of the airtight chamber 50, and accordingly, the pre-stroke pressure within the airtight chamber 50. As the piston head 72 of the resistance adjusting piston 70 moves inwardly, the volume of the airtight chamber 50 is reduced and the pre-stroke pressure of the airtight chamber 50 is increased. This will result in a greater force necessary to pull the cable 18 from the cable spool 20 in order to move the first piston 48 against the force of the air pressure within the airtight chamber 50. Naturally, movement of the piston head 72 of the resistance adjusting piston 70 outwardly will increase the volume of the airtight chamber 50 and reduce the pre-stroke pressure within the airtight chamber 50, thereby making it easier to pull the cable 18 from the cable spool 20.

In one embodiment, as shown in FIG. 4, movement of the adjusting piston rod 70 to change the pre-stroke pressure is achieved by rotating the adjusting nut 74 on the exterior of the frame 56. This action turns the grooved adjusting piston rod 70 to thereby achieve axial inward or outward movement of the piston rod 75 and piston head 72 relative to the airtight chamber 50.

Another embodiment of the pre-stroke pressure adjusting control is shown in FIGS. 5 and 6. Specifically, a resistance setting selector knob 76 is turned clockwise or counterclockwise to an indicated adjusted setting representing resistance value or the equivalent of weight necessary to overcome the force of resistance of rotation of the cable spool 20 by movement of the handheld device 10 away from the anchor point 24A-24E. Turning the setting selector knob 76 results in rotation of a first bevel gear 78 which in turn rotates a second bevel gear 80. Rotation of the bevel gears 78 and 80 causes the piston rod 75 of the resistance adjusting piston 70 to be advanced or retracted relative to the airtight chamber 50. This axial inward or outward movement of the piston rod 75 and piston head 72 relative to the airtight chamber 50 changes the volume of the airtight chamber 50 and, accordingly, the pre-stroke pressure within the airtight chamber 50.

Figure 7C:
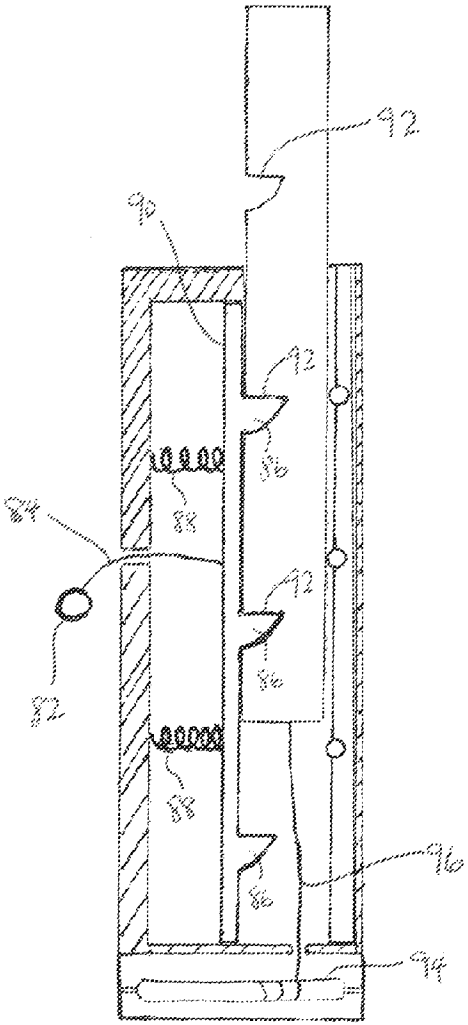
FIGS. 7A-7C show a cross-section of the anchor arm and extender arm assembly of the embodiments of FIG. 3, illustrating a sequence of operation for adjustably extending and retracting the extender arm relative to the anchor arm at various locked positions.
Figure 7B:
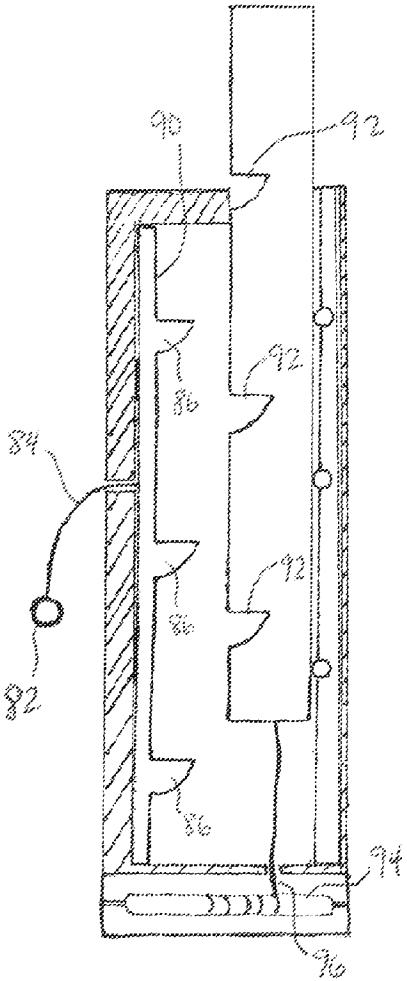
Figure 7A:
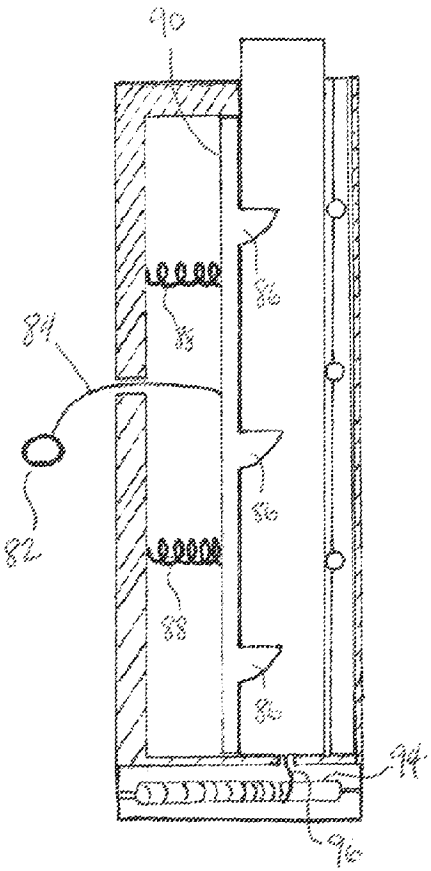

Referring to FIG. 7A-7C, the anchor arm 36A and 36B and extender arm 40 assembly of the embodiment of FIG. 3 is shown in more detail to illustrate the mechanism and sequence of operation for extending and retracting the extender arms 40 relative to the respective anchor arms 36A and 36B. Referring initially to FIG. 7A, the user pulls the pull ring 82 which is attached to the top end of the extender arm 40 via the pull string 84. This action pulls the extender arm 40 past the locking nubs 86 while compressing the locking springs 88 and displacing the locking plate 90, as seen in FIG. 7B. As the extender arm 40 is pulled past the locking nubs 86 and the locking holes 92 align with the next set of locking nubs 86, the locking springs 88 push the locking plate 90 against the extender arm 40, allowing the locking nubs 86 to be received within the aligned locking holes 92, thereby locking the extender arm 40 in this adjusted extended position, as shown in FIG. 7C. This action can be repeated to further extend the extender arm 40 to a fully extended position.

To retract the extender arm 40 back into the anchor arm 36A or 36B, the user pulls the retracting pull ring 82 which is connected to the locking plate 90 via the retracting pull ring 82. This action compresses the locking springs 88 and pulls the locking plate 90 and locking nubs 86 away from the locking holes 92 which allows the spring loaded cable spool 94 to retract the retracting cable 96 and the extender arm 40 via its connection to the retracting cable 96.

Figure 8:
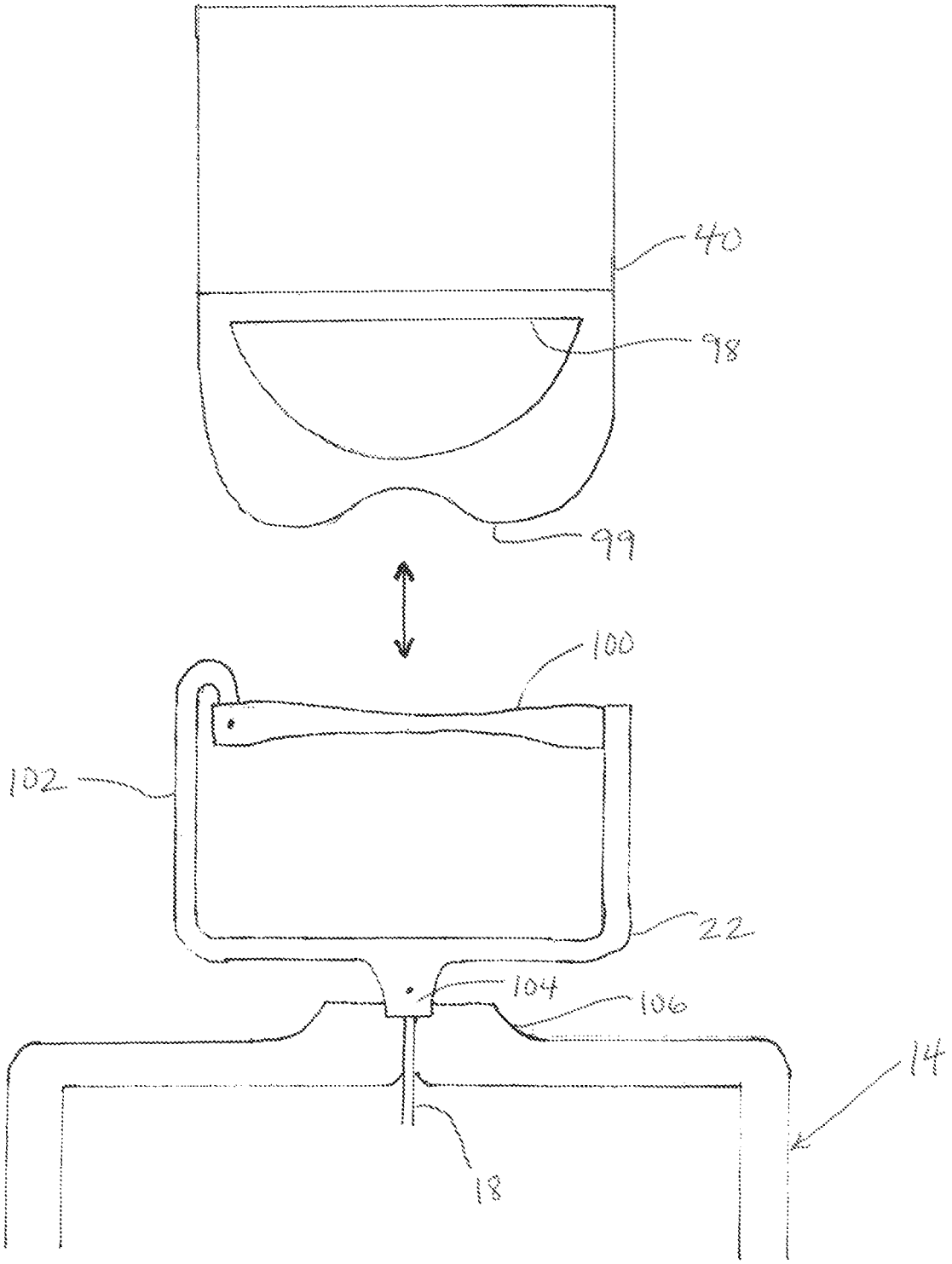
FIG. 8 is a top plan view illustrating one embodiment of a quick connect fitting on the end of the cable of an adjustable resistance handheld exercise assisting device for releasable attachment to a D ring, defining an anchor point, on the end of the arms of the embodiment of FIG. 3.

FIG. 8 illustrates one embodiment of the quick connect fitting 22 on the end of the cable 18 of the handheld devices 14 and 16 for easy and rapid connection and disconnection to the end of the extender arm 40 on each anchor arm, as shown in the embodiment of FIG. 3. Specifically, to achieve quick connection of the cable end of the handheld exercise device to the end of the extender arm 40, the handheld device 14 or 16 is pushed toward the extender arm 40 and affixed to modified D ring 98 on the end of the extender arm 40. Coupling bar 100 makes contact with the modified D ring 98 and slides into place and is pushed open by the modified D ring groove 99. Once pushed far enough, the coupling bar 100 snaps back shut, thereby locking the modified D ring 98 onto the coupling ring 102. When the handheld exercise device 14 or 16 is pulled away from the extender arm 40 and modified D ring 98, the coupling ring 102 remains connected. At the end of the exercise, the handheld exercise device 14 or 16 is put back to the starting point adjacent to the modified D ring 98. The coupling ring stem 104 is now back in the handheld exercise device coupling head 106. The user then opens the coupling bar 100 and releases the coupling ring 102 from the modified D ring 98.

While the present invention has been shown and described in accordance with several embodiments thereof, it is recognized that departures from the instant disclosure are fully contemplated within the spirit and scope of the invention as defined in the following claims.

What is claimed is:

1. An adjustable resistance exercise apparatus comprising:

a handheld device including a frame member with a frame axle and at least one frame grip;

a cable spool rotatably supported on the frame axle;

a cable having a first end fixed to the cable spool, and the cable spool being structured to wind the cable about an exterior thereof;

an resistance adjusting mechanism for imparting an adjustable force of resistance to rotation of said cable spool and including a first piston having a piston head that moves against pressure within a variable volume airtight chamber upon rotation of said cable spool and a second piston defining a resistance adjustment piston having a piston head that is adjustably movable within said airtight chamber for varying the volume of said airtight chamber, and thereby changing the air pressure therein and the force of resistance against the inward movement of said first piston within said airtight chamber;

a quick connect fitting on an opposite end of said cable for releasable attachment to an anchor point; and whereby forced movement of said handheld device away from the anchor point pulls the cable from said anchor spool, thereby causing the anchor spool to rotate against the force of resistance imparted by the resistance adjusting mechanism.

2. The adjustable resistance exercise apparatus as recited in claim 1 further comprising:

a rigid garment structured to be worn on the user's body and including at least one connection fitting defining said anchor point for removable attaching of the quick connect fitting on the end of the cable.

3. The adjustable resistance exercise apparatus as recited in claim 2 further wherein said rigid garment is a vest-like structure adapted to be worn over the user's torso and including a rigid chest plate and a plurality of said connection fittings defining a plurality of said anchor points.

4. The adjustable resistance exercise apparatus as recited in claim 3 further wherein said rigid garment further comprises:

at least one adjustable arm on the back of the vest-like structure, and said at least one adjustable arm having a connection fitting defining said anchor point.

5. The adjustable resistance exercise apparatus as recited in claim 2 further wherein said rigid garment is a belt adapted to be worn around the user's waist and including said at least one connection fitting defining said anchor point.

6. The adjustable resistance exercise apparatus as recited in claim 1 wherein said handheld device is a hand grip adapted to be grasped in one hand and moved by one arm of the user.

7. The adjustable resistance exercise apparatus as recited in claim 1 wherein said handheld device is a bar grip adapted to be grasped in both hands and moved by both arms of the user.

8. The adjustable resistance apparatus as recited in claim 1 wherein said resistance adjusting mechanism further comprises a fixed gear affixed to an inner surface of said cable spool, said fixed gear being in threaded connection with said first piston, and said fixed gear being structured and disposed for moving said piston head against pressure with the variable volume airtight chamber upon rotation of said cable spool.

9. An adjustable resistance exercise apparatus comprising:

a handheld device including a frame member with a frame axle and at least one hand grip;

a cable spool rotatably supported on the frame axle;

a cable having a first end fixed to the cable spool, and the cable spool being structured to wind the cable about an exterior thereof;

a resistance adjusting mechanism for imparting an adjustable force of resistance to rotation of said cable spool and including a first piston having a piston head that moves against pressure within a variable volume airtight chamber upon rotation of said cable spool;

a quick connect fitting on an opposite end of said cable for releasable attachment to an anchor point; and whereby forced movement of said handheld device away from the anchor point pulls the cable from said anchor spool, thereby causing the anchor spool to rotate against the force of resistance imparted by the resistance adjusting mechanism.

10. The adjustable resistance exercise apparatus as recited in claim 9 wherein said resistance adjusting mechanism includes a second piston defining a resistance adjustment piston having a piston head that is adjustably movable within said airtight chamber for varying the volume of said airtight chamber, and thereby changing the air pressure therein and the force of resistance against the inward movement of said first piston within said airtight chamber.

11. The adjustable resistance exercise apparatus as recited in claim 9 further comprising:

a rigid garment structured to be worn on the user's body and including at least one connection fitting defining said anchor point for removable attaching of the quick connect fitting on the end of the cable.

12. The adjustable resistance exercise apparatus as recited in claim 11 further wherein said rigid garment is a vest-like structure adapted to be worn over the user's torso and including a rigid chest plate and a plurality of said connection fittings defining a plurality of said anchor points.

13. The adjustable resistance exercise apparatus as recited in claim 12 further wherein said rigid garment further comprises:

at least one adjustable arm on the back of the vest-like structure, and said at least one adjustable arm having a connection fitting defining said anchor point.

14. The adjustable resistance exercise apparatus as recited in claim 11 further wherein said rigid garment is a belt adapted to be worn around the user's waist and including said at least one connection fitting defining said anchor point.

15. The adjustable resistance exercise apparatus as recited in claim 9 wherein said handheld device is a hand grip adapted to be grasped in one hand and moved by one arm of the user.

16. The adjustable resistance exercise apparatus as recited in claim 9 wherein said handheld device is a bar grip adapted to be grasped in both hands and moved by both arms of the user.

17. The adjustable resistance apparatus as recited in claim 10 wherein said resistance adjusting mechanism further comprises a fixed gear affixed to an inner surface of said cable spool, said fixed gear being in threaded connection with said first piston, and said fixed gear being structured and disposed for moving said piston head against pressure with the variable volume airtight chamber upon rotation of said cable spool.

* * * * *